US010173760B2

(12) United States Patent
Ewers et al.

(10) Patent No.: US 10,173,760 B2
(45) Date of Patent: Jan. 8, 2019

(54) DEVICE FOR REDUCING EFFECTIVE RADAR CROSS SECTION

(71) Applicants: ThyssenKrupp Marine Systems GmbH, Kiel (DE); ThyssenKrupp AG, Essen (DE)

(72) Inventors: Dirk Ewers, Rosengarten (DE); Wolfram Determann, Norderstedt (DE)

(73) Assignees: ThyssenKrupp Marine Systems GmbH, Kiel (DE); thyssenkrupp AG, Essen (DE)

( * ) Notice: Subject to any disclaimer, the term of this patent is extended or adjusted under 35 U.S.C. 154(b) by 0 days.

(21) Appl. No.: 15/126,374

(22) PCT Filed: Mar. 3, 2015

(86) PCT No.: PCT/EP2015/054372
§ 371 (c)(1),
(2) Date: Sep. 15, 2016

(87) PCT Pub. No.: WO2015/139943
PCT Pub. Date: Sep. 24, 2015

(65) Prior Publication Data

US 2017/0088243 A1 Mar. 30, 2017

(30) Foreign Application Priority Data

Mar. 17, 2014 (DE) ..... 10 2014 103 601

(51) Int. Cl.
*B63G 13/02* (2006.01)
*H01Q 1/34* (2006.01)
(Continued)

(52) U.S. Cl.
CPC ..... *B63G 13/02* (2013.01); *B63G 8/34* (2013.01); *H01Q 1/34* (2013.01); *H01Q 15/18* (2013.01); *B63G 2013/027* (2013.01); *F41H 3/00* (2013.01)

(58) Field of Classification Search
CPC ..... B63G 8/34; B63G 13/00; B63G 13/02; B63G 2013/025; B63G 2013/027;
(Continued)

(56) References Cited

U.S. PATENT DOCUMENTS 4,708,757 A * 11/1987 Guthrie ..... B32B 37/144 156/163
4,953,922 A * 9/1990 Granqvist ..... F41H 3/00 2/900
(Continued)

FOREIGN PATENT DOCUMENTS

DE 19752137 A1 8/1999
GB 1326909 A * 8/1973 ..... B05D 5/12
(Continued)

OTHER PUBLICATIONS

International Search Report and Written Opinion for International Application No. PCT/EP2015/054372 dated Jun. 25, 2015, 11 pages.

*Primary Examiner* — Ajay Vasudeva
(74) *Attorney, Agent, or Firm* — RMCK Law Group PLC

(57) ABSTRACT

A device for reducing the effective radar cross section (RCS) of a naval vessel is proposed, the device comprising a cladding panel, which can be mounted on vessel superstructures or cargo of the naval vessel, the cladding panel being permeable to radar beams, the device also comprising a reflection means, which reflects radar beams, and the reflection means also being embedded in the cladding panel and
(Continued)

being aligned at least partially inclined with respect to a main plane of extent of the cladding panel.

19 Claims, 1 Drawing Sheet

(51) Int. Cl.
*H01Q 15/18* (2006.01)
*F41H 3/00* (2006.01)
*B63G 8/34* (2006.01)

(58) Field of Classification Search
CPC ..... H01Q 1/34; H01Q 15/18; H01Q 17/00; H01Q 17/001; F41H 3/00; F41H 3/02
See application file for complete search history.

(56) References Cited

U.S. PATENT DOCUMENTS 5,288,538 A * 2/1994 Spears ..... B29C 44/1228 428/116
5,922,986 A * 7/1999 Wanninger ..... F41H 5/007 342/3
6,148,586 A * 11/2000 Jandl ..... E04C 2/22 52/309.7
6,613,420 B1 * 9/2003 Leupolz ..... F41H 3/00 428/212
6,738,007 B1 * 5/2004 Stafford ..... B63G 13/02 342/3
7,271,759 B1 * 9/2007 Bofinger ..... F41H 3/00 342/3
7,366,472 B2 * 4/2008 Messano ..... H01Q 1/526 174/377
2006/0169930 A1 * 8/2006 Butler ..... H01Q 15/0006 250/505.1
2008/0236077 A1 * 10/2008 O'Reilly ..... E04C 2/205 52/309.8
2014/0254000 A1 * 9/2014 O'Keefe ..... F41H 3/00 359/359

FOREIGN PATENT DOCUMENTS

JP 05254897 A * 10/1993
JP 09074296 A * 3/1997
KR 20100045185 A 5/2010
WO 0109562 A1 2/2001
WO 2005020373 A1 3/2005
WO 2013050727 A2 4/2013

* cited by examiner

DEVICE FOR REDUCING EFFECTIVE RADAR CROSS SECTION

CROSS-REFERENCE TO RELATED APPLICATIONS

This application is a 371 U.S. National Stage of International Application No. PCT/EP2015/054372, filed Mar. 3, 2015, which claims priority to German Application No. 10 2014 103 601.8 filed on Mar. 17, 2014. The disclosure of each of the above applications is incorporated herein by reference in their entirety.

PRIOR ART

The present disclosure is based on a device for reducing the effective radar cross section of a naval vessel which comprises a reflection means for the reflection of radar beams.

It is endeavoured to reduce the effective radar cross section (RCS) of naval vessels, in particular when they are for military use, to make detection of the naval vessel more difficult. Radar detection is based on the principle according to which radar waves are emitted by a radar set as primary waves and are reflected by the object to be detected and returned as secondary waves in the form of radar echoes. The secondary waves are detected by the radar set and used to obtain information concerning the distance of the object, the direction of the object and possibly the size and contour of the object. Radar detection is thus made more difficult by fewer radar echoes being reflected in the direction of the detecting radar set. The effective radar cross section (RCS) or radar signature is said to be reduced. This can be achieved by the surfaces of the naval vessel, i.e. in particular the hull, the superstructures and any cargo on deck, being formed spherically and without right angles, in order to be conducive to isotropic reflections. However, these design objectives cannot always be met. For example, cargo is often transported on modern naval vessels in standardized ISO containers that are securely lashed on deck and, in compliance with their standard, are always cuboidally formed, so that it is not practical to do away with all right angles and create spherical surfaces.

To solve this problem, the prior art discloses for example cladding elements for cladding parts of a vessel, the cladding elements being constructed in such a way that they absorb incident radar waves and in this way the production of radar echoes is suppressed. Such cladding elements are comparatively cost-intensive and complex.

The document WO 2005/020 373 A1 also discloses a cladding element for reducing the radar cross section that consists of an irregular array of individual radar-reflecting elements, which are arranged angularly in order to reflect the incident radar waves in different spatial directions and consequently prevent a clear radar echo. A disadvantage of this solution is that a smooth surface cannot be achieved and there is a considerable space requirement.

DISCLOSURE OF THE INVENTION

An object of the present disclosure is to provide a device which on the one hand reduces the effective radar cross section (RCS) of a naval vessel and on the other hand has a low space requirement and a low weight, and also can be flexibly retrofitted and is inexpensive. Moreover, it is intended that a substantially neutral or conventional outer appearance of the naval vessel should be made possible in spite of the device.

This object is achieved by a device for reducing the effective radar cross section (RCS) of a naval vessel comprising a cladding panel, which can be mounted on vessel superstructures or cargo of the naval vessel, the cladding panel being permeable to radar beams, the device also comprising a reflection means, which reflects radar beams, and the reflection means being embedded in the cladding panel and being aligned at least partially inclined with respect to a main plane of extent of the cladding panel.

The device according to the disclosure has the advantage over the prior art that the reflection means is integrated in the cladding panel, so that the surface of the cladding panel does not comprise any regions with an alignment that is inclined with respect to the main plane of extent. In this way, a neutral or conventional outer appearance of the naval vessel can be retained with regard to form and colouring, and at the same time the radar cross section (RCS) can be reduced, since the radar-reflecting part is partially inclined with respect to the main plane of extent, and consequently the incident radar beams are not reflected directly back to the sender of the radar waves. In other words: the reflection means is formed in particular in such a way that radar beams that are incident on the reflection means along a direction of incidence that is substantially perpendicular to the main plane of extent are reflected by the reflection means in a direction of reflection that deviates from the antiparallel direction of incidence. The integration of the reflection means in the cladding panel also has the advantage that the device can be retrofitted in an easy and flexible way, since this merely requires that the cladding panel is mounted on the corresponding vessel superstructures and/or cargo. The radar echo can even be reduced for cargo in the form of standardized ISO containers by cladding with the device according to the disclosure as a camouflage cap. It is in this way advantageously possible to dispense with the cost-intensive transformation of the geometry of the vessel or the geometry of the cargo, for example into objects with exclusively spherical surfaces.

Advantageous refinements and developments of the disclosure can be taken from the subclaims and the description with reference to the drawings.

According to a preferred embodiment of the present disclosure, it is provided that the reflection means comprises a sawtooth profile. The sawtooth profile makes it possible in a particularly efficient way to provide a reflection means in which the reflection areas are always inclined with respect to the main plane of extent, and consequently a reflection of incident radar beams directly back to the sender is suppressed. At the same time, the sawtooth profile prevents the thickness of the reflection means perpendicularly to the main plane of extent from becoming too great, and consequently mounting becoming more difficult. The sawtooth profile is preferably achieved by the reflection means being made up of a plurality of first and second reflection slopes, which are arranged alternately along a main direction of extent of the reflection means.

According to a preferred embodiment of the present disclosure, it is provided that a first angle is formed between the main plane of extent and the first reflection slope and a second angle is formed between the main plane of extent and the second reflection slope, the first angle and the second angle being unequal and, in particular, the first angle being smaller than the second angle. In an advantageous way, the first and second reflection slopes are consequently inclined differently in relation to the main plane of extent. It is conceivable that the first angle lies between 5 and 60 degrees and particularly preferably between 10 and 30, most particularly preferably between 15 and 25 degrees, and/or that the second angle lies between 60 and 100 degrees and particularly preferably between 70 and 90, most particularly preferably at substantially 85 degrees.

According to a preferred embodiment of the present disclosure, it is provided that the cladding panel comprises a substantially rigid sandwich panel. In an advantageous way, the cladding panel is consequently comparatively light and can be produced inexpensively. The sandwich panel preferably comprises two outer layers and a core arranged between the two outer layers. The outer layers preferably respectively comprise glass-fibre reinforced plastic, while the core preferably comprises a foam core. The reflection means is in particular embedded in the core. The surface of the cladding panel can consequently be adapted to the conventional visual appearance of the naval vessel. Its lightweight construction allows the cladding panel also to be mounted on movable parts, such as for example hatches or flaps.

According to a preferred embodiment of the present disclosure, it is provided that the reflection means comprises a conductive film. It is conceivable for example that the reflection means comprises a metal inlay, a woven fabric and/or a carbon-fibre reinforced plastic inlay. In an advantageous way, on the one hand a high reflectivity of the reflection means and on the other hand inexpensive and easy production are consequently achieved.

A further subject matter of the present disclosure is a naval vessel comprising a vessel superstructure or cargo on which the device according to the disclosure is mounted. In an advantageous way, the vessel superstructures and/or cargo arranged on the vessel is/are clad with the device according to the disclosure, so that the radar echo of the naval vessel is reduced and the naval vessel can consequently be detected significantly less well by means of radar.

Further details, features and advantages of the disclosure emerge from the drawings, and from the following description of preferred embodiments on the basis of the drawings. The drawings thereby merely illustrate exemplary embodiments of the disclosure that do not restrict the essential concept of the disclosure.

EMBODIMENTS OF THE INVENTION

In the various figures, the same parts are always provided with the same designations, and are therefore in each case also generally only referred to or mentioned once.

Figure 1:
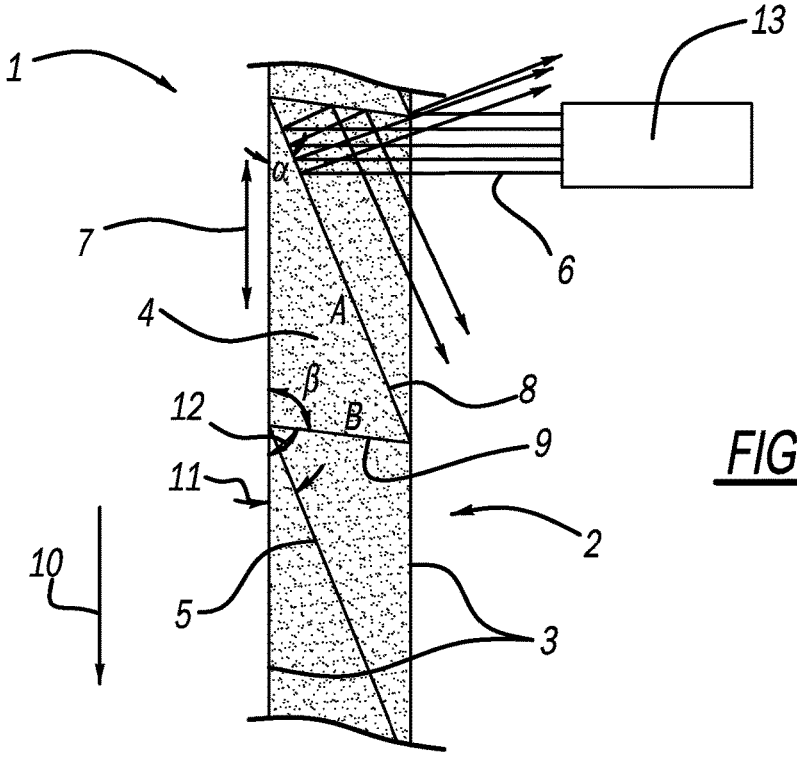
FIG. 1 shows a schematic view of a sectional image of a device according to an exemplary embodiment of the present disclosure.

In FIG. 1, a schematic view of a sectional image of a device 1 for reducing the effective radar cross section (RCS) of a naval vessel 14 according to an exemplary embodiment of the present disclosure is represented.

The device 1 comprises a cladding panel 2, which takes the form of a rigid or semirigid sandwich panel. For this, the cladding panel 2 comprises two outer layers 3 of glass-fibre reinforced plastic (GRP) and a core 4, which is arranged between the two outer layers 3. The core 4 comprises a foam core, preferably a polyurethane foam (PU). The composite of the outer layers 3 with the foam core provides the cladding panel 2 with a high load-bearing capacity and great stiffness, with at the same time very low weight. Moreover, the cladding panel 2 is permeable to radar beams 6, so that no appreciable radar echo emanates from the planar surface of the cladding panel 2, which extends along a main plane of extent 7.

Figure 2:
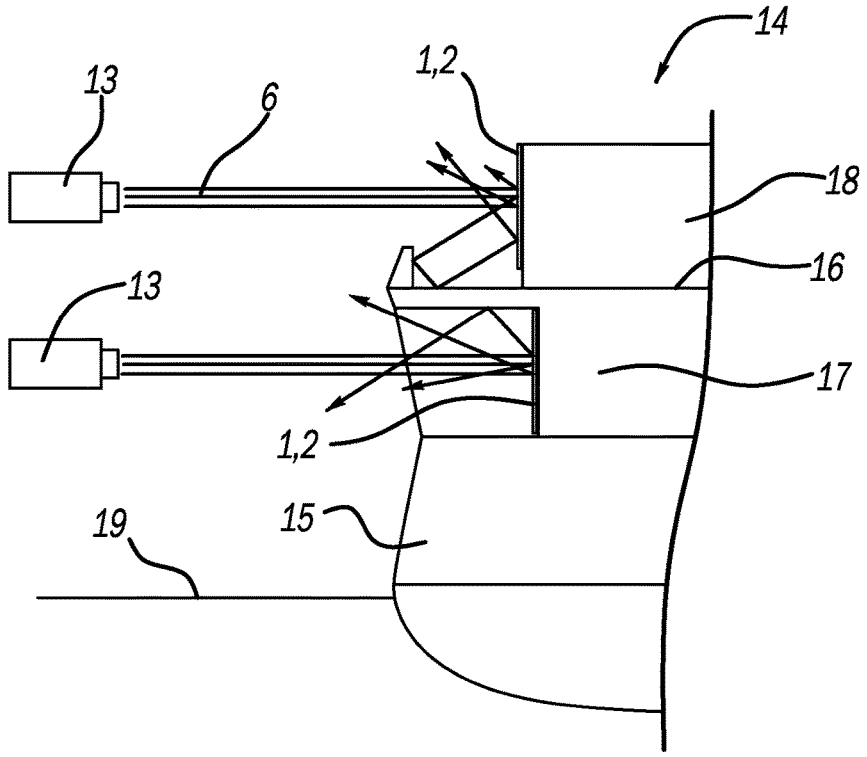
FIG. 2 shows a schematic partial view of a naval vessel with a device according to the exemplary embodiment of the present disclosure.

The cladding panel 2 is intended to be mounted on vessel superstructures (17) of the naval vessel 14 or on cargo (18) that is transported on the deck of the naval vessel 14, in order to reduce their effective radar cross section (RCS) (see FIG. 2). The low weight of the cladding panel 2 considerably facilitates mounting. Being formed as a panel also makes easy mounting or retrofitting on planar surfaces possible. Securement on mounting openings, flaps or in niches can also be achieved. The smooth surface of the cladding panel 2 also allows a coating or colouring of the cladding panel 2 that is adapted to the conventional visual appearance of a naval vessel 14. In this way, the cladding panel 2 can for example be made marine grey.

The cladding panel 2 also comprises a reflection means 5, which is integrated or adhesively incorporated in the foam core 4. The reflection means 5 takes the form of a metal inlay, whereby radar beams 6 are reflected by the reflection means 5. The reflection means 5 takes the form of a sawtooth profile or is stepped, so that the surface subregions of the reflection means 5 are always inclined with respect to the main plane of extent 7 of the cladding panel 2. Alternatively, the reflection means 5 comprises a woven fabric (gauze) and/or a carbon-fibre reinforced plastic inlay (CRP).

In order that the cladding panel 2 can nevertheless be made as thin as possible along a direction perpendicular to the main plane of extent 7, the reflection means 5 is made up of a plurality of first and second reflection slopes 8, 9, which are arranged alternately along a main direction of extent 10 of the reflection means 5 that is parallel to the main plane of extent 7. In this case, a first angle 11 is formed between the main plane of extent 7 and the first reflection slope 8 and a second angle 12 is formed between the main plane of extent 7 and the second reflection slope 9, the first angle 11 always being smaller than the second angle 12. Furthermore, the area of the second reflection slope 9 is always smaller than the area of the first reflection slope 8.

The reflection slopes 8, 9, inclined with respect to the main plane of extent 7, ensure that radar beams 6 that are incident on the reflection means 5 along a direction of incidence that is substantially perpendicular to the main plane of extent 7 are reflected by the reflection means 5 in a direction of reflection that deviates from the antiparallel direction of incidence. In other words: radar beams 6 that are emitted from a radar source 13 and are incident perpendicularly on the cladding panel 2 are not reflected frontally back to the radar source 13, but are deflected by the reflection means 5 in other spatial directions with directional components parallel to the main plane of extent 7. This has the advantage that a radar set connected to the radar sources 13 receives a smaller radar echo, and radar detection of the naval vessel 14 provided with the device 1 according to the disclosure is made more difficult. The effective radar cross section (RCS) of the naval vessel 14 is therefore reduced considerably.

In FIG. 2, a schematic partial view of a naval vessel 14 with a device 1 according to the exemplary embodiment of the present disclosure is represented. The device 1 corresponds to the device 1 explained above on the basis of FIG. 1 for reducing the effective radar cross section (RCS) of a naval vessel 14.

In the present example, part of the vessel hull 15 and the deck 16 of the naval vessel 14 are shown. The cladding panels 2 are in this case mounted on vertical areas of vessel superstructures 17 and cargo 18 secured on the deck 16 in order not to reflect the incident radar beams from radar sources 13 of other vessels back in the direction of these radar sources 13, but to send them in other spatial directions, and consequently make radar detection of the naval vessel 14 more difficult.

LIST OF DESIGNATIONS

1 Device
2 Cladding panel
3 Outer layer
4 Core
5 Reflection means
6 Radar beams
7 Main plane of extent
8 First reflection slope
9 Second reflection slope
10 Main direction of extent
11 First angle
12 Second angle
13 Radar source
14 Naval vessel
15 Vessel hull
16 Deck
17 Superstructures
18 Cargo
19 Waterline

The invention claimed is:

1. A device for reducing the effective radar cross section (RCS) of a naval vessel, the device comprising:

a cladding panel configured to be mounted on one of vessel superstructures and cargo of the naval vessel, the cladding panel being permeable to radar and comprising:

two outer layers; and a core disposed between the two outer layers; and a radar reflector, which reflects radar beams, wherein the radar reflector is encased inside the core and is at least partially inclined with respect to (i) a main plane of an extent of the cladding panel and (ii) an outer planar surface of the cladding panel, the outer planar surface extending substantially parallel to the main plane of extent.

2. The device of claim 1, wherein the radar reflector is formed in such a way that radar beams that are incident on the radar reflector along a direction of incidence that is substantially perpendicular to the main plane of extent are reflected by the radar reflector in a direction of reflection that deviates from the antiparallel direction of incidence.

3. The device of claim 2, wherein the radar reflector comprises a sawtooth profile.

4. The device of claim 2, wherein the radar reflector is made up of a plurality of first and second reflection slopes, which are arranged alternately along a main direction of extent of the radar reflector.

5. The device of claim 4, wherein a first angle is formed between the main plane of extent and the first reflection slope and wherein a second angle is formed between the main plane of extent and the second reflection slope, the first angle being smaller than the second angle.

6. The device of claim 5, wherein the first angle lies between 5 and 60 degrees.

7. The device of claim 6 wherein the first angle lies between 10 and 30 degrees.

8. The device of claim 7 wherein the first angle lies between 15 and 25 degrees.

9. The device of claim 5 wherein the second angle lies between 60 and 100 degrees.

10. The device of claim 9 wherein the second angle lies between 70 and 90 degrees.

11. The device of claim 10 wherein the second angle lies at substantially 85 degrees.

12. The device of claim 4, wherein each first reflection slope includes a first end and an opposite second end, and each second reflection slope includes a first end and an opposite second end, wherein the first reflection slope first end is disposed at a first acute angle relative to the main plane of extent and a second acute angle relative to an adjacent second reflection slope first end, and wherein the first reflection slope second end is disposed at a third acute angle relative to the main plane of extent and a fourth acute angle relative to an adjacent second reflection slope second end.

13. The device of claim 1, wherein the outer layers respectively comprise glass-fibre reinforced plastic and the core comprises a foam core.

14. The device of claim 1, wherein the radar reflector comprises a conductive film.

15. The device of claim 1, wherein the radar reflector comprises at least one of a metal inlay, a woven fabric and a carbon-fibre reinforced plastic inlay.

16. A naval vessel comprising a vessel superstructure or cargo, the naval vessel having mounted thereto:

a cladding panel being permeable to radar beams and including a core disposed between first and second layers; and a radar reflector, which reflects radar beams, wherein the radar reflector is encased inside the core and is at least partially inclined with respect to the first and second layers of the cladding panel.

17. A device for reducing the effective radar cross section (RCS) of an object, the device comprising:

a cladding panel configured to be mounted on the object, the cladding panel being permeable to radar and comprising:

opposed first and second outer layers, the first outer layer configured to be coupled to the object, and the second outer layer defining an outer planar surface of the cladding panel, wherein the first outer layer and the second outer layer extend along a main direction of extent of the cladding panel; and a core disposed between the first outer layer and the second outer layer; and a radar reflector which reflects radar beams, wherein the radar reflector is encased inside the core of the cladding panel and is inclined with respect to the outer planar surface of the cladding panel.

18. The device of claim 17, further comprising:

wherein the outer planar surface of the cladding panel is arranged to face away from the object toward a radar source, wherein the radar reflector includes a plurality of first and second reflection slopes arranged alternately along the main direction of extent of the cladding panel.

19. The device of claim 17, wherein the first and second outer layers are parallel such that the outer planar surface of the cladding panel does not include any regions with an alignment that is inclined with respect to a main plane of extent of the cladding panel.

* * * * *